US008089012B2

(12) United States Patent
Mohtasham et al.

(10) Patent No.: US 8,089,012 B2
(45) Date of Patent: Jan. 3, 2012

(54) SAFETY SWITCH

(75) Inventors: Medi Mohtasham, Astley (GB); Hamed Faridfar, Altherton (GB)

(73) Assignee: Idem Safety Switches Limited, Leigh (GB)

( * ) Notice: Subject to any disclaimer, the term of this patent is extended or adjusted under 35 U.S.C. 154(b) by 356 days.

(21) Appl. No.: 12/443,811

(22) PCT Filed: Oct. 16, 2007

(86) PCT No.: PCT/GB2007/003938

§ 371 (c)(1),
(2), (4) Date: Mar. 31, 2009

(87) PCT Pub. No.: WO2008/047102

PCT Pub. Date: Apr. 24, 2008

(65) Prior Publication Data

US 2010/0044204 A1 Feb. 25, 2010

(51) Int. Cl.
*H01H 17/08* (2006.01)

(52) U.S. Cl. ..... 200/61.18; 200/543; 200/334

(58) Field of Classification Search ..... 200/61.13, 200/61.14, 61.18, 519, 537–539, 542–546, 200/329, 331, 334, 47, 573, 574; 254/231, 254/234

See application file for complete search history.

(56) References Cited

U.S. PATENT DOCUMENTS 4,306,126 A * 12/1981 Howard ..... 200/52 R
5,003,135 A * 3/1991 Piccoli ..... 200/52 R
5,041,705 A * 8/1991 Piccoli ..... 200/52 R
5,530,215 A * 6/1996 Couvreur ..... 200/83 R
5,665,947 A * 9/1997 Falcon ..... 200/61.18
5,760,357 A * 6/1998 Nakamura et al. ..... 200/33 B
5,821,488 A * 10/1998 Falcon ..... 200/52 R
5,964,342 A * 10/1999 Wecke et al. ..... 200/534
6,365,850 B1 * 4/2002 Arnold et al. ..... 200/17 R
6,501,040 B2 * 12/2002 Hall et al. ..... 200/543
6,646,212 B2 * 11/2003 Mohtasham ..... 200/61.18
7,022,930 B2 * 4/2006 Hall et al. ..... 200/543
2002/0175058 A1 * 11/2002 Mohtasham ..... 200/17 R

FOREIGN PATENT DOCUMENTS

DE 17 65 116 A1 7/1971
DE 39 09 743 A1 10/1989
DE 39 09 744 A1 10/1989
EP 1 255 262 A 11/2002
WO 97 20334 A 6/1997

* cited by examiner

*Primary Examiner* — Michael Friedhofer
(74) *Attorney, Agent, or Firm* — Quarles & Brady LLP; Gavin J. Milczarek-Desai

(57) ABSTRACT

A safety switch 2 used in conjunction with a cable as a machine guard, the switch being actuated to cut power to attendant machinery when a predetermined tension in the cable is varied by for example pulling the cable, or the cable becoming loose. The switch 2 comprising a sliding cam 14 which is connected to a connection point 12 for the cable via a spring loaded shaft 10 which shaft also supplies said predetermined tension and acts to move said sliding cam 14 in a first plane when the predetermined tension is varied. The sliding cam 14 then acts on a transverse cam 36 moving it in a plane transversely disposed to said first plane which in turn acts to cut said power 30, 52.

19 Claims, 15 Drawing Sheets

SAFETY SWITCH

The present invention relates to safety switches and in particular, but not exclusively to a cable actuated safety switch used in a machine guard to control the power to a machine.

Cable actuated safety switches are conventionally used in applications where an emergency stop capability is required over an extended distance. To this end a cable is disposed in tension in close proximity about the machine. The cable is operatively connected to the safety switch. Pulling on the cable causes the switch to operate and to thereby cut power to the machine.

It is an object of the present invention to provide a safety switch which has a positive pull mechanism which will enable the switch to activate smoothly enabling a fast cut-off of power to machinery when the attached cable is pulled or if the cable goes slack and therefore loses tension. It is a further object to provide a safety switch with means to prevent an accidental reset of the switch whilst enabling a controlled and easy reset. It is yet a further object to provide an auxiliary emergency stop which enables a fast operation of the switch thereby enabling an emergency stop without pulling on the cable.

In accordance with the present invention there is provided a safety switch comprising a transverse cam, a sliding cam which acts on the transverse cam to move it from a first position in which said transverse cam enables a power supply to a second position in which said transverse cam acts to cut said power supply, wherein said sliding cam has connecting means to connect to a cable, tension means to provide a predetermined tension in a connected cable and moving means to move said sliding cam when said applied predetermined tension varies, and wherein said sliding cam is moveable in a first plane and said transverse cam movement is in a second plane transversely disposed to said first plane.

The switch may have means to releasably retain the transverse cam in said first and/or second position. The means to retain may comprise at least one fixed structure comprising at least one detent and/or spring loaded plunger, the other of which is carried on a surface of the transverse cam, the spring loaded plunger being adapted to be releasably retained in the detent. In a preferred embodiment there are two pairs of oppositely disposed detents which are spaced apart in a plane parallel to said second plane, and a pair of oppositely disposed said plungers, wherein in said first position of said transverse cam the oppositely disposed plungers extend into a respective first of said pair of detents and in said second position the plungers extend into respective said second pair of said detents. The second pair of detents may be arranged so as to be deeper than said first pair.

The switch may be provided with a manually operable reset plunger which act on the transverse cam in the opposite direction to the sliding cam.

The switch may be provided with an emergency stop button which has means to move the transverse cam to said second position thereof. In a preferred embodiment the transverse cam has a protrusion and the emergency button has means to act on said protrusion. The switch may be provided with at least two mountings for said emergency button. This has the advantage that the emergency button can be mounted in at least two locations enabling the position to be selected which is most accessible to the user depending on the orientation of the mounting of the safety switch.

The connecting and moving means may include a shaft on which the sliding cam is mounted, and may comprise an eyelet also mounted to the shaft. The shaft may be spring loaded to provide said tension means.

The means to enable the power supply may comprise an abutment profile on the surface of the transverse cam for the switching contact of a switching mechanism.

The switching mechanism may be of the type comprising a contact block wherein the switching contact is a spring loaded plunger.

The switching contact may be a spring loaded plunger of a contact block which is biased for movement out of the contact block, wherein said abutment profile has means to move the plunger into the contact block when in said first or second position of the transverse cam.

The spring loaded plunger may be biased out of the contact block to enable power to be supplied, said power being cut when the plunger is moved into the contact block, wherein the means on the abutment profile to move the plunger into the contact block operates the plunger when the transverse cam is in said second position.

The switch may incorporate a switching mechanism as described.

An abutment profile may be provided on the surface of the transverse cam facing the sliding cam having at least two abutment surfaces for the sliding cam, wherein said means to move said sliding cam is adapted to move the sliding cam in a first direction in said first plane when said cable tension exceeds said predetermined tension and to abut a first of said abutment surfaces to move the transverse cam, and said means to move is adapted to move the sliding cam in the opposing direction in said plane when said cable tension is less than said predetermined tension and to abut the other of the abutment surfaces to move the transverse cam.

In a further embodiment the safety switch is adapted to enable the connection of two cables under a predetermined tension to this end the switch comprises two sliding cams with respective connecting means to connect to respective cables, and also respective moving means to move its sliding cam when said predetermined tension varies, in its respective attached cable, each sliding cam is independently or together adapted to move the transverse cam from its first to second position in order to cut the power to attendent machinery. Each sliding cam may have a side by side disposition and may comprise at least one abutment which acts on the transverse cam to move such when the sliding cam is moved due to change in predetermined tension. The sliding cam may also have an abutment which prevents the transverse cam being returned to its first position when the attached cable is not correctly tensioned.

By way of example only specific embodiments of the invention will now be described with reference to the accompanying drawings, in which.

Figure 1:
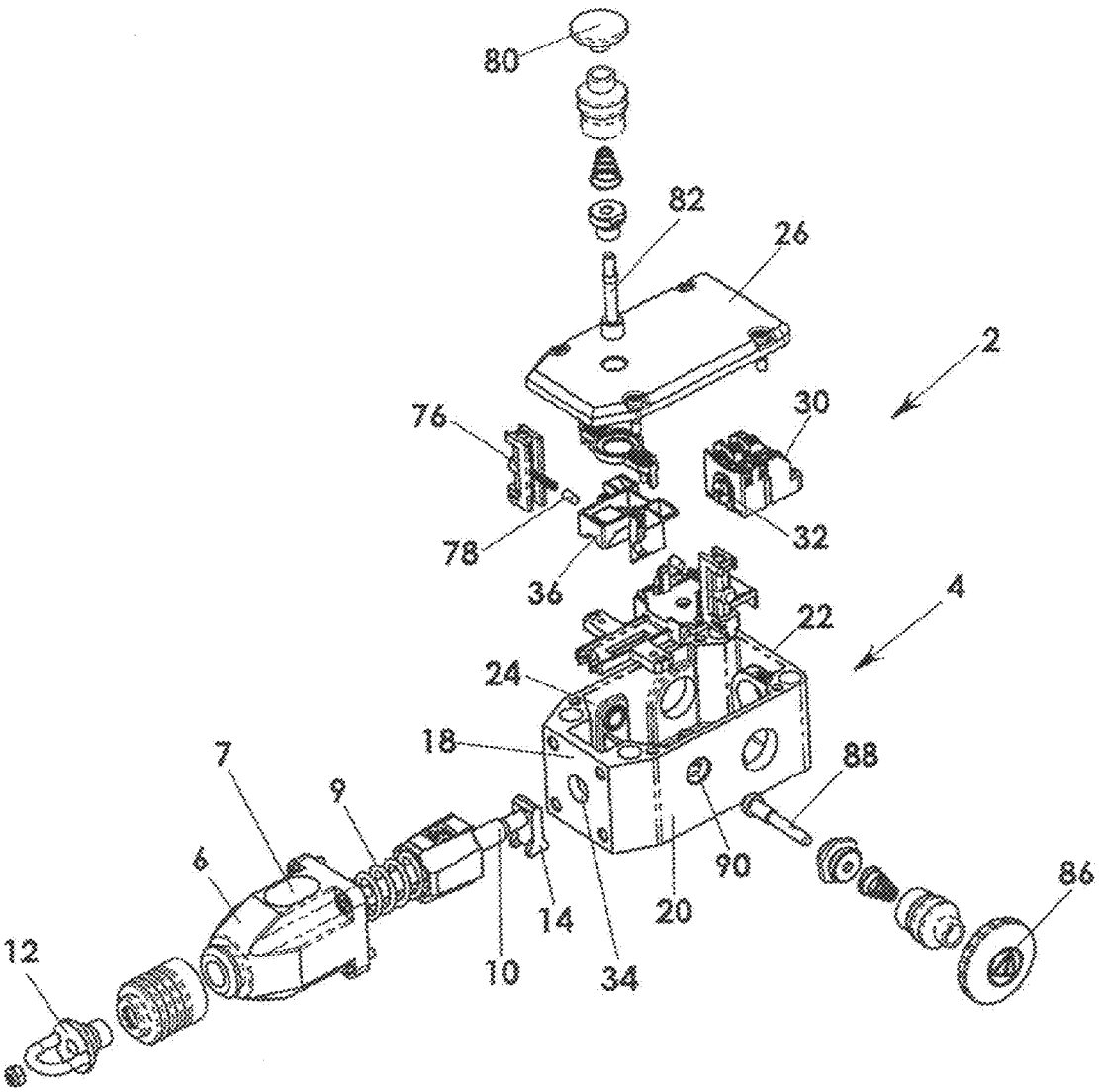
FIG. 1 is an exploded perspective view of a first embodiment of safety switch.
Figure 2:
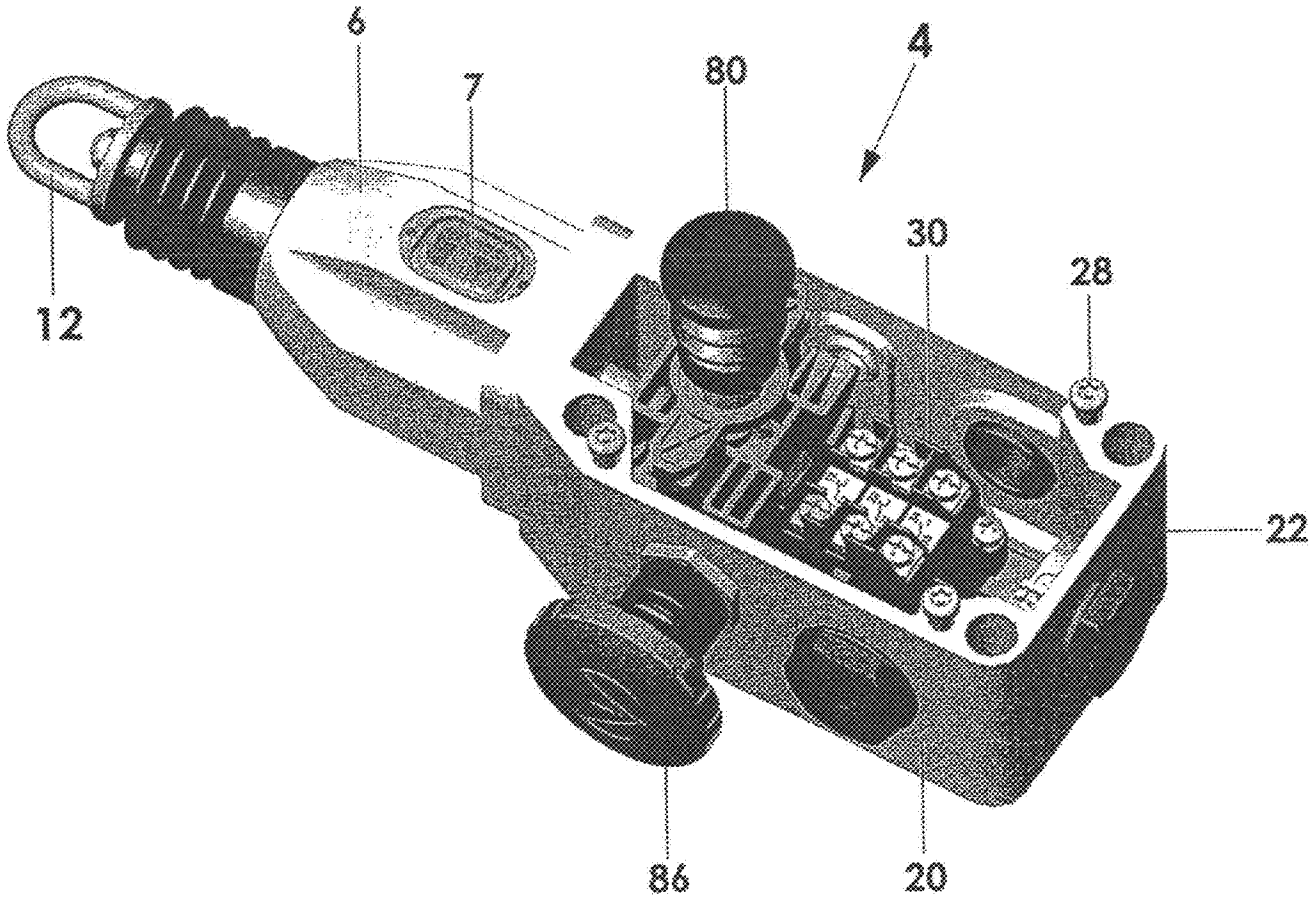
FIG. 2 is a perspective plan view of the first embodiment of safety switch with top of housing removed to better illustrate internal mechanism.
Figure 3:
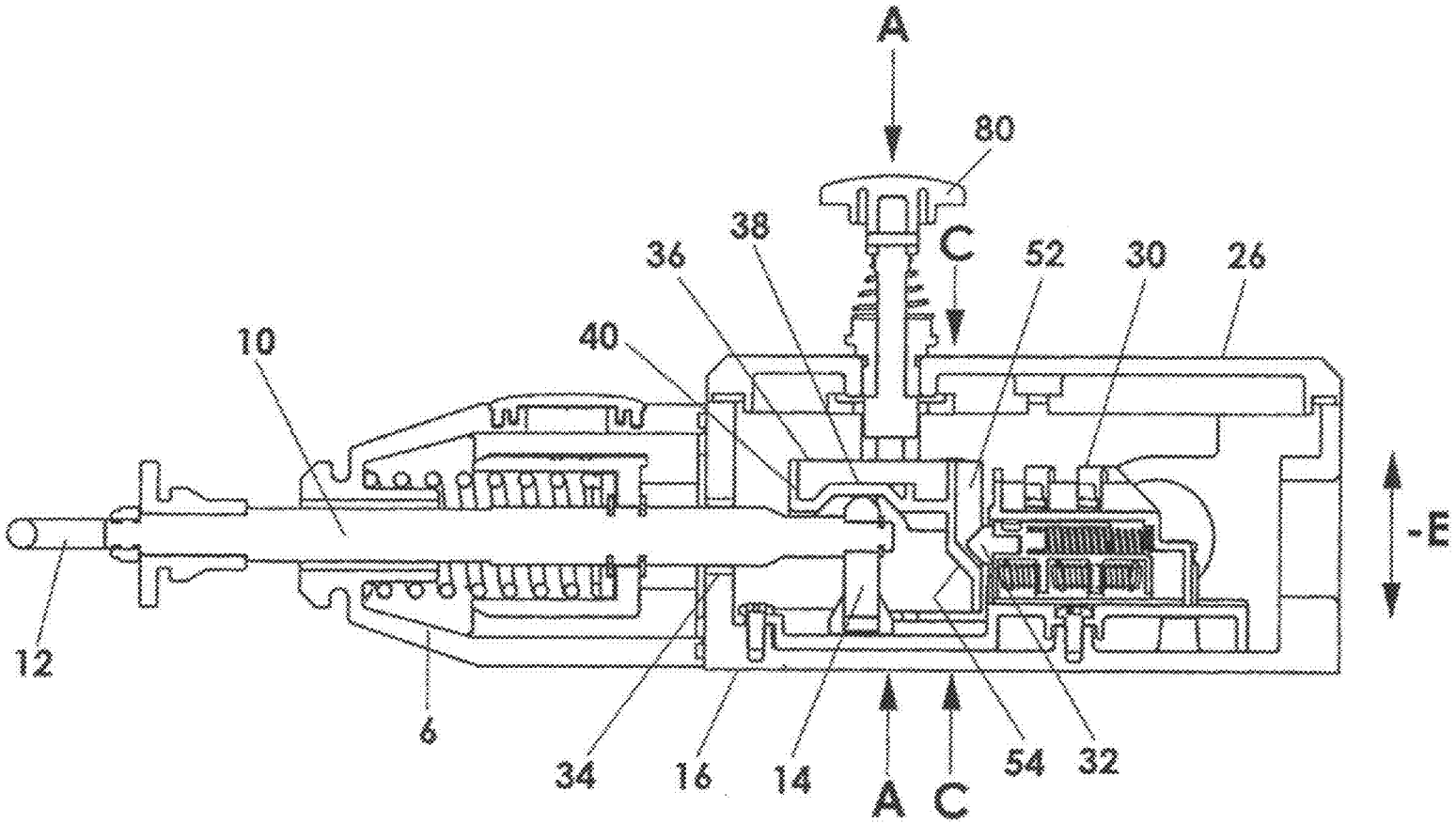
FIG. 3 is a longitudinal sectional view of the first embodiment of safety switch, illustrated in the switch on condition, rope tensioned.
Figure 4:
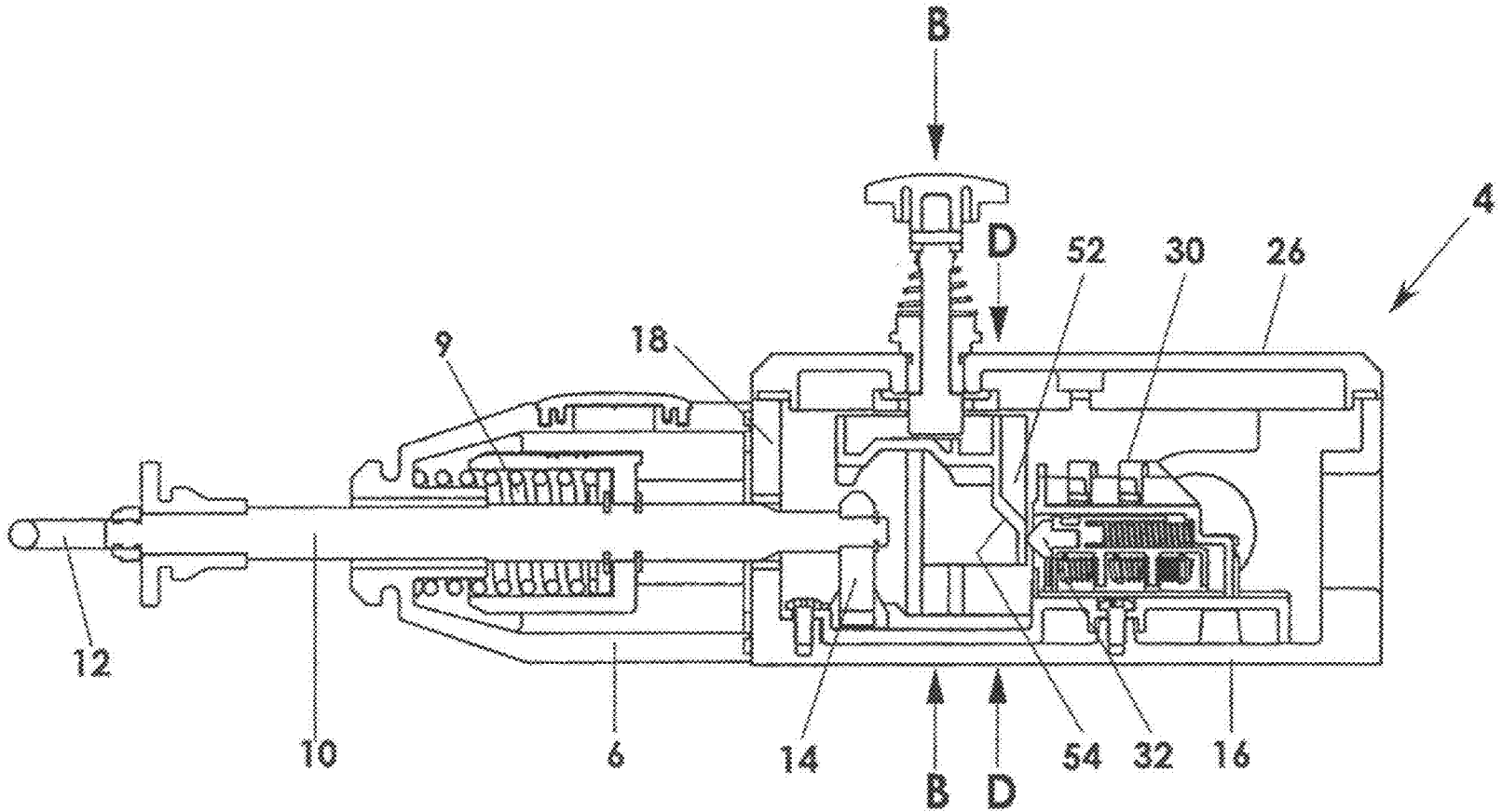
FIG. 4 is a view similar to that of FIG. 3 with the switch in the off-condition, rope pulled.
Figure 5:
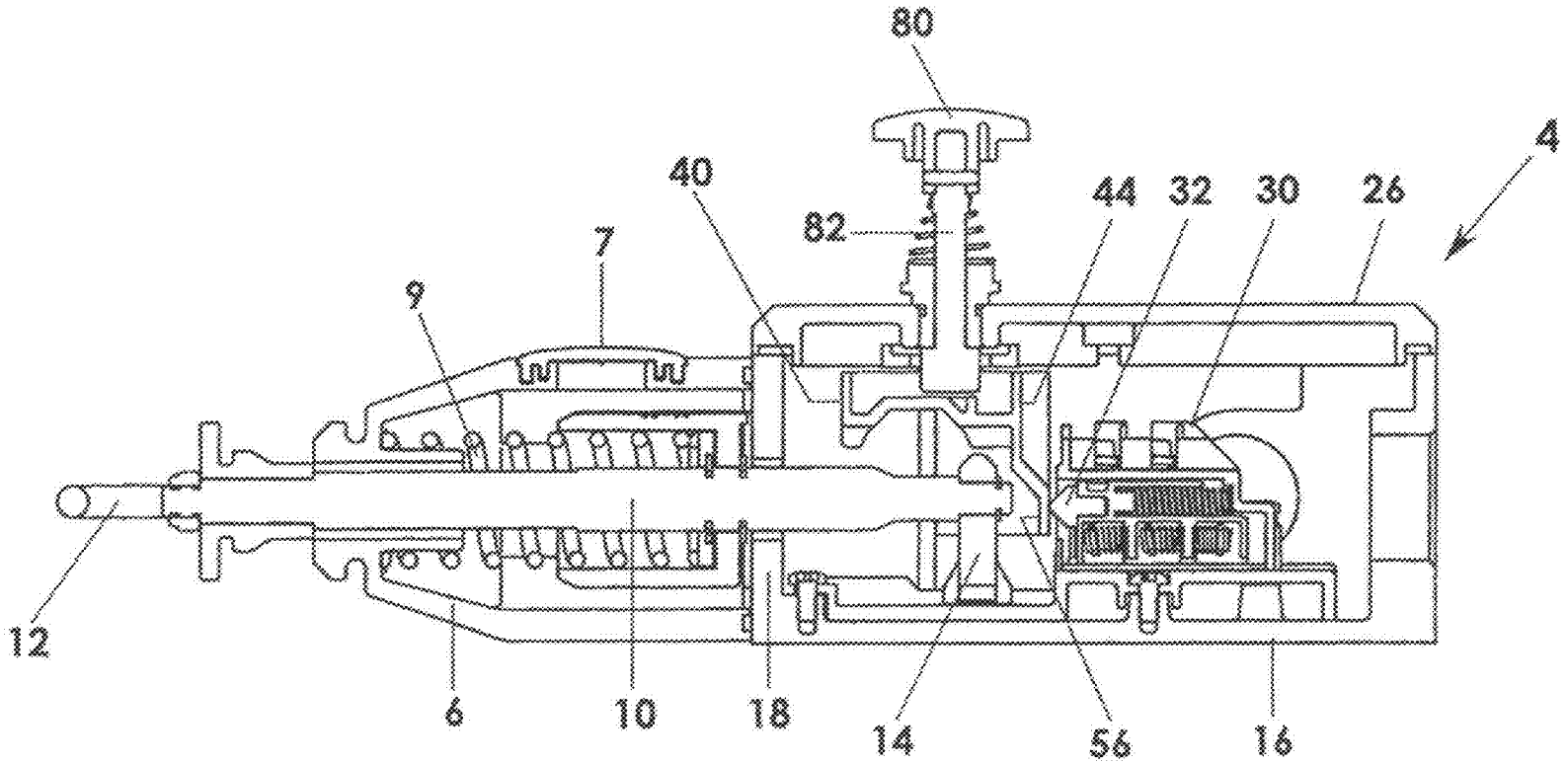
FIG. 5 is a view similar to that of FIG. 3 with the switch in the off-condition, rope slack or broken.
Figure 5A:
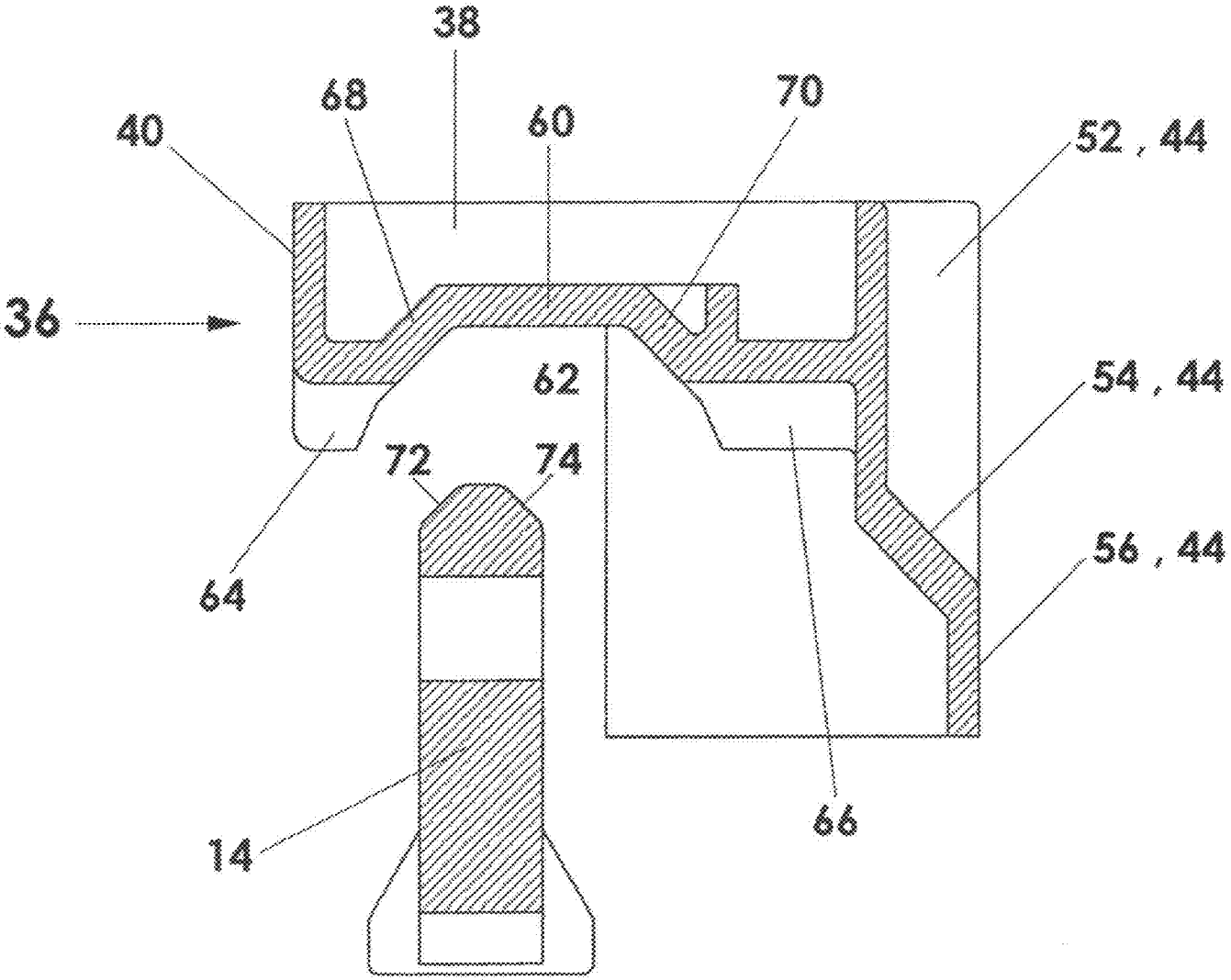
Figure 6:
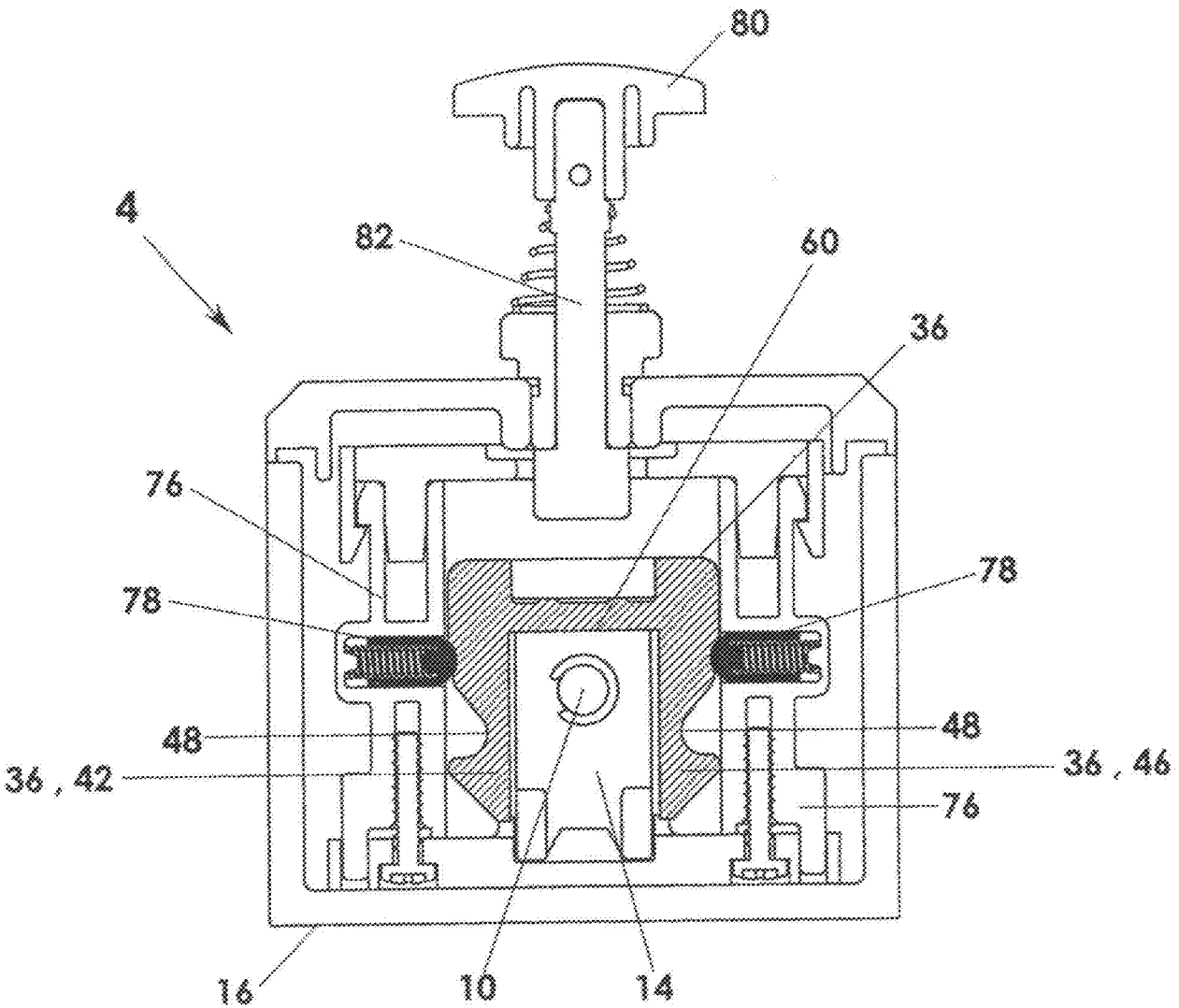
Figure 7:
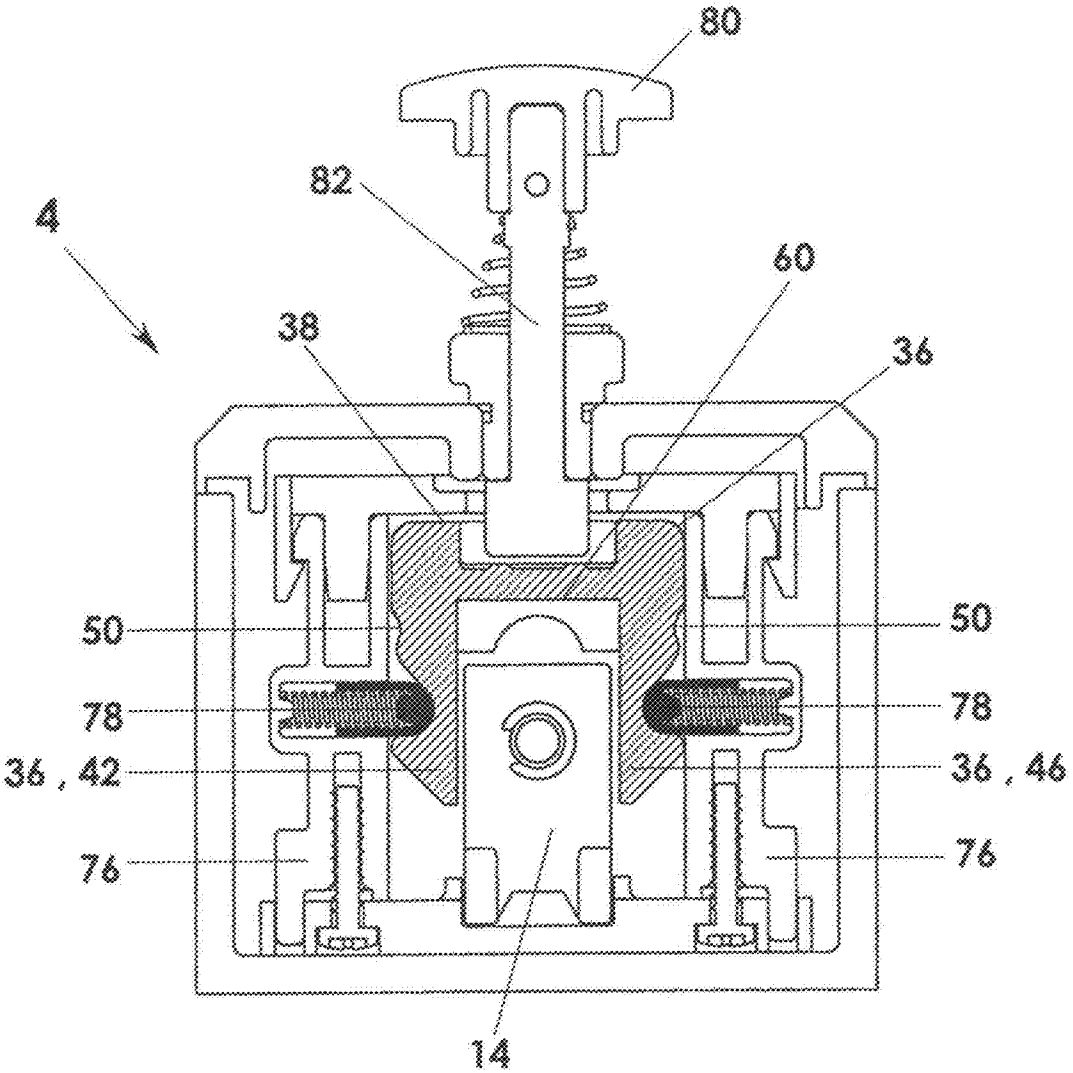
Figure 8:
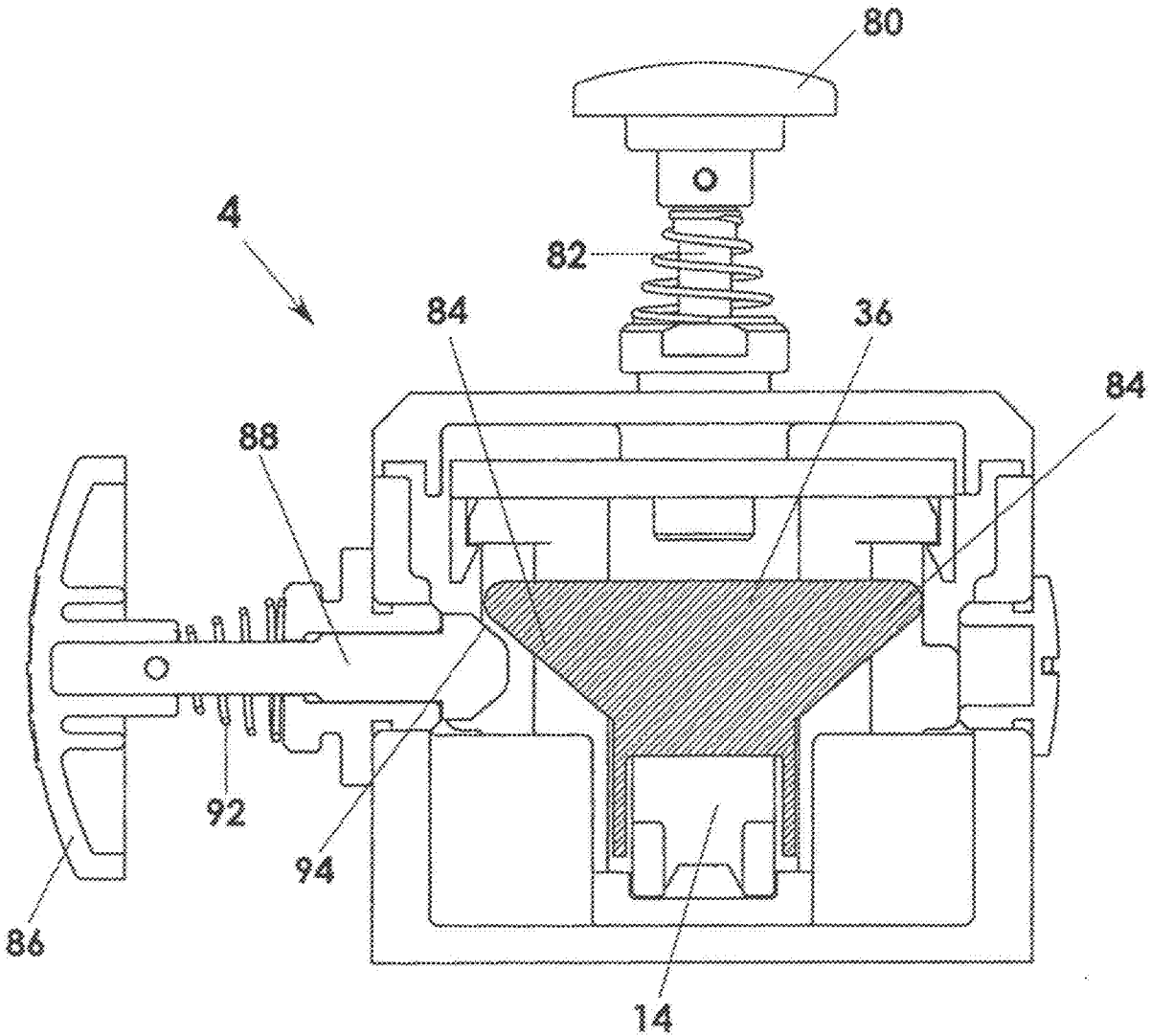
Figure 9:
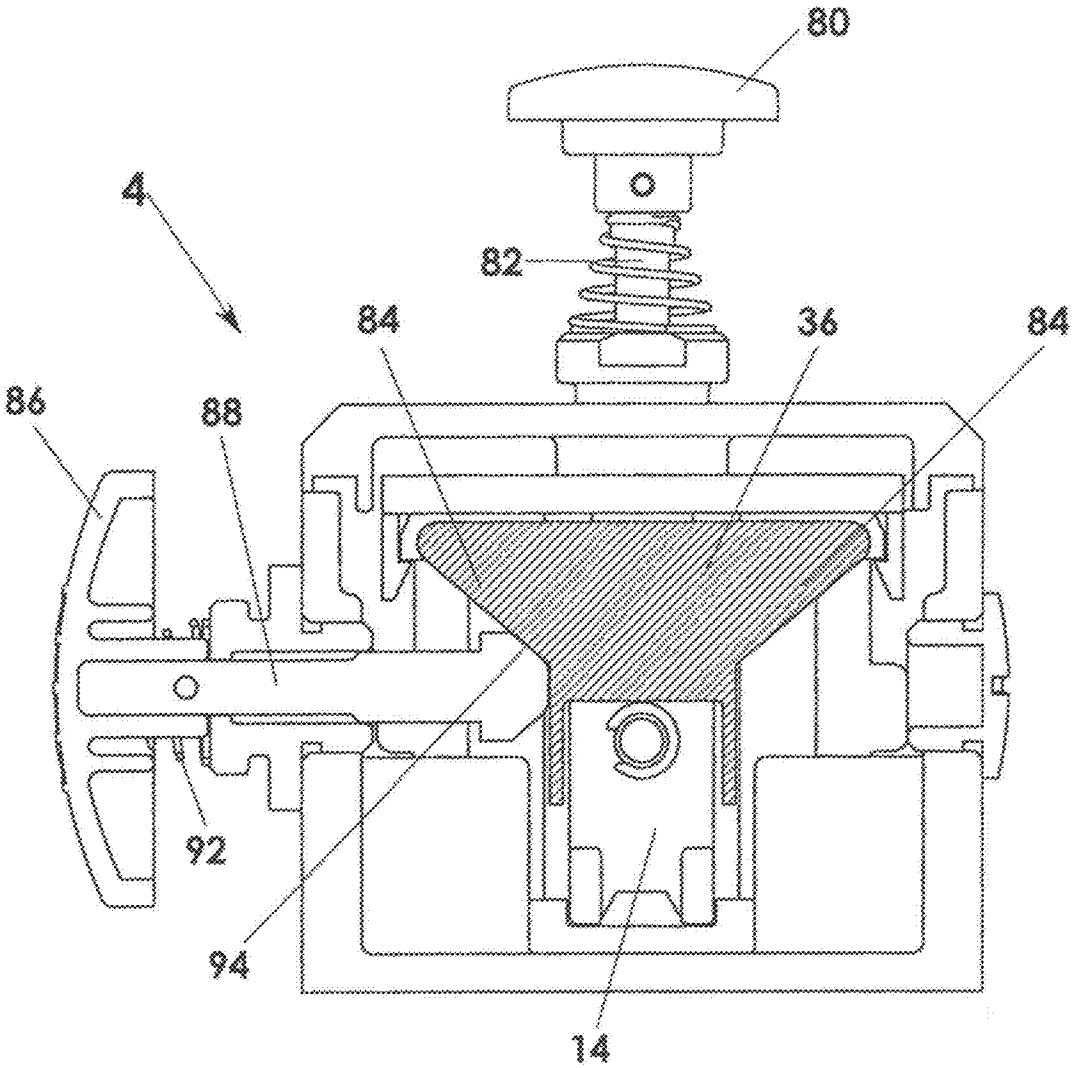

FIG. 5*a* is a detail of the transverse cam of FIG. 5;

FIG. 6 is a transverse sectional view along the lines A-A of FIG. 3;

FIG. 7 is a transverse sectional view along the lines B-B of FIG. 4;

FIG. 8 is a transverse sectional view along the lines C-C of FIG. 3;

FIG. 9 is a transverse sectional view along the lines D-D FIG. 4.

Figure 10:
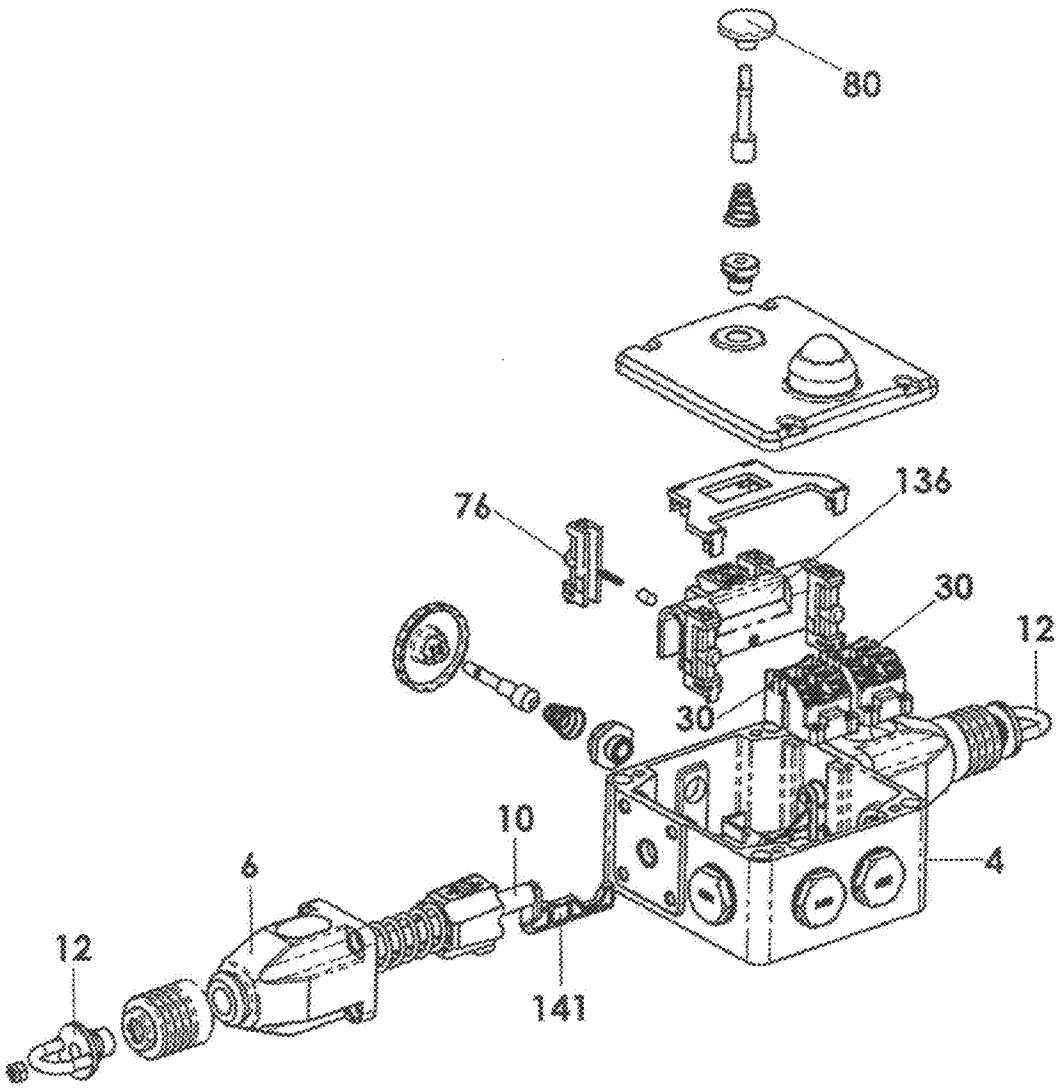
Figure 11:
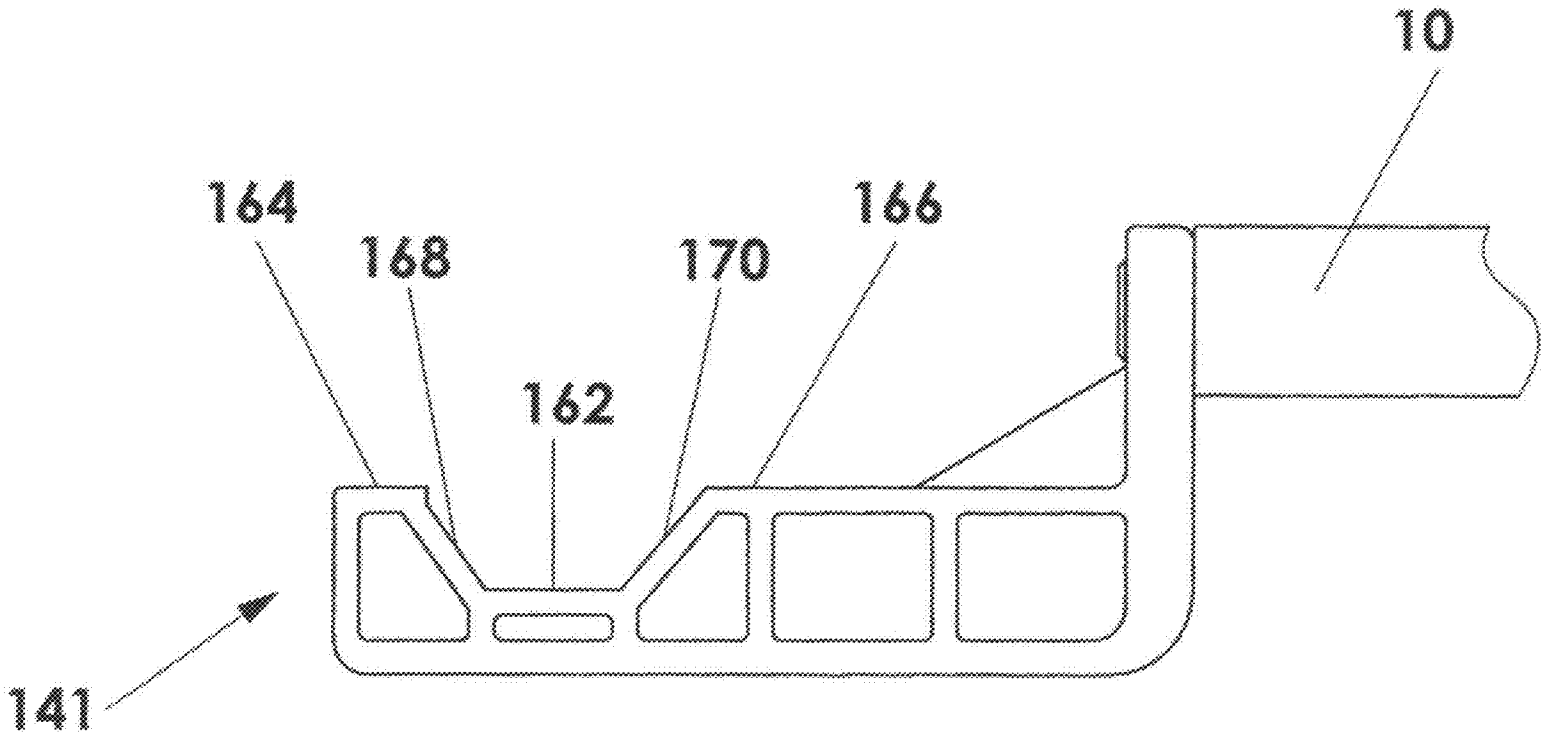
Figure 12:
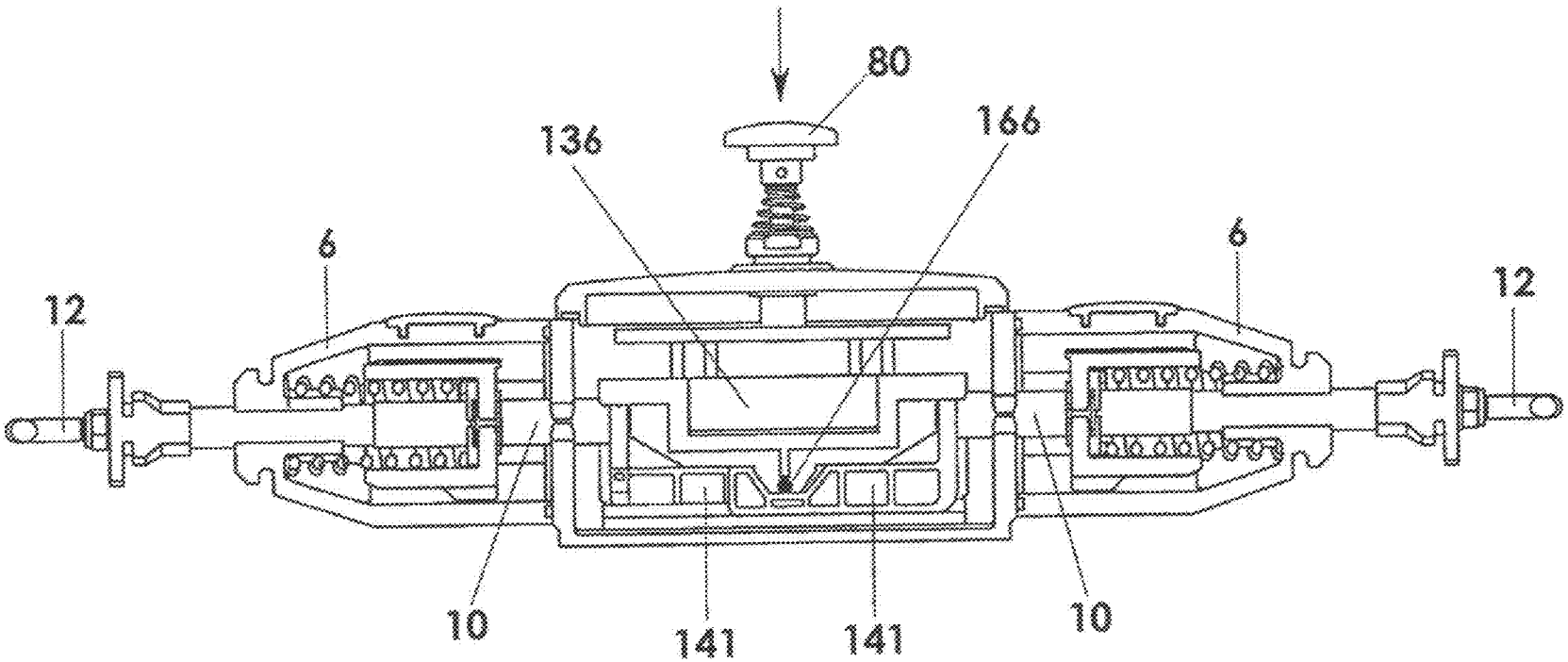
Figure 13:
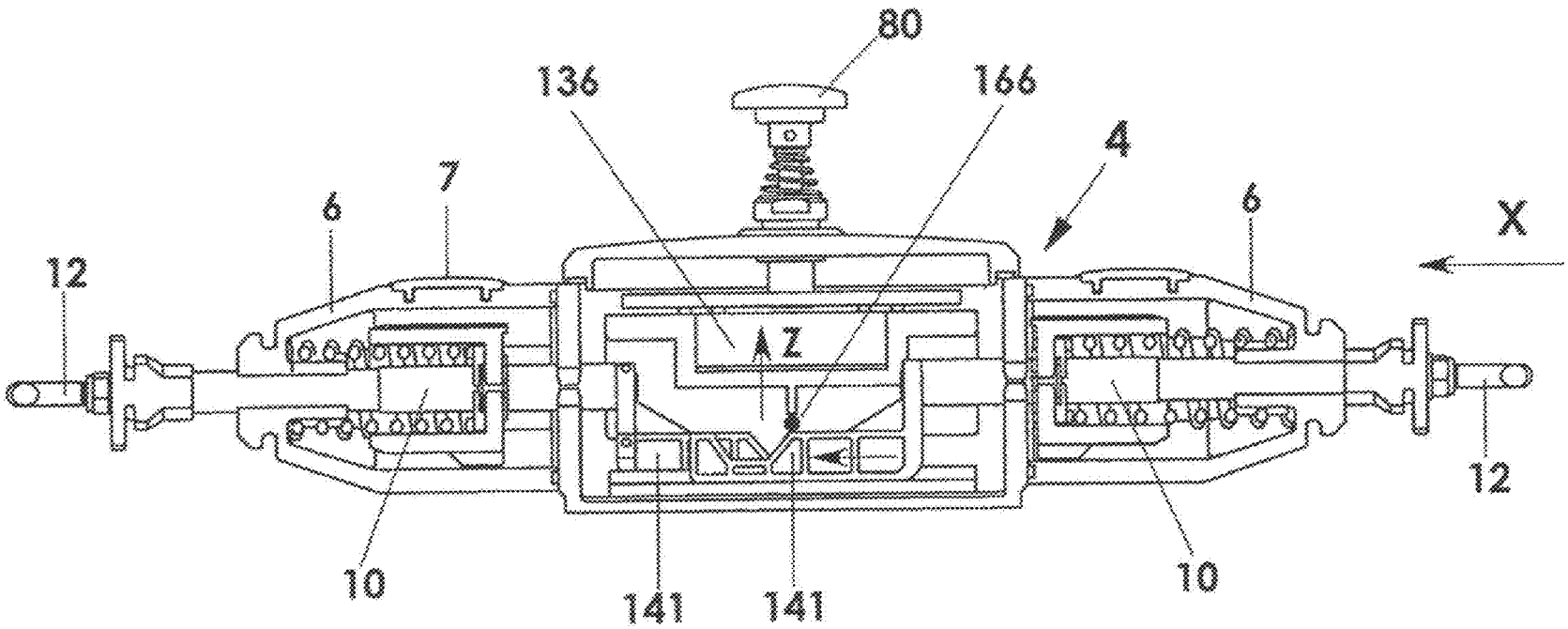
Figure 14:
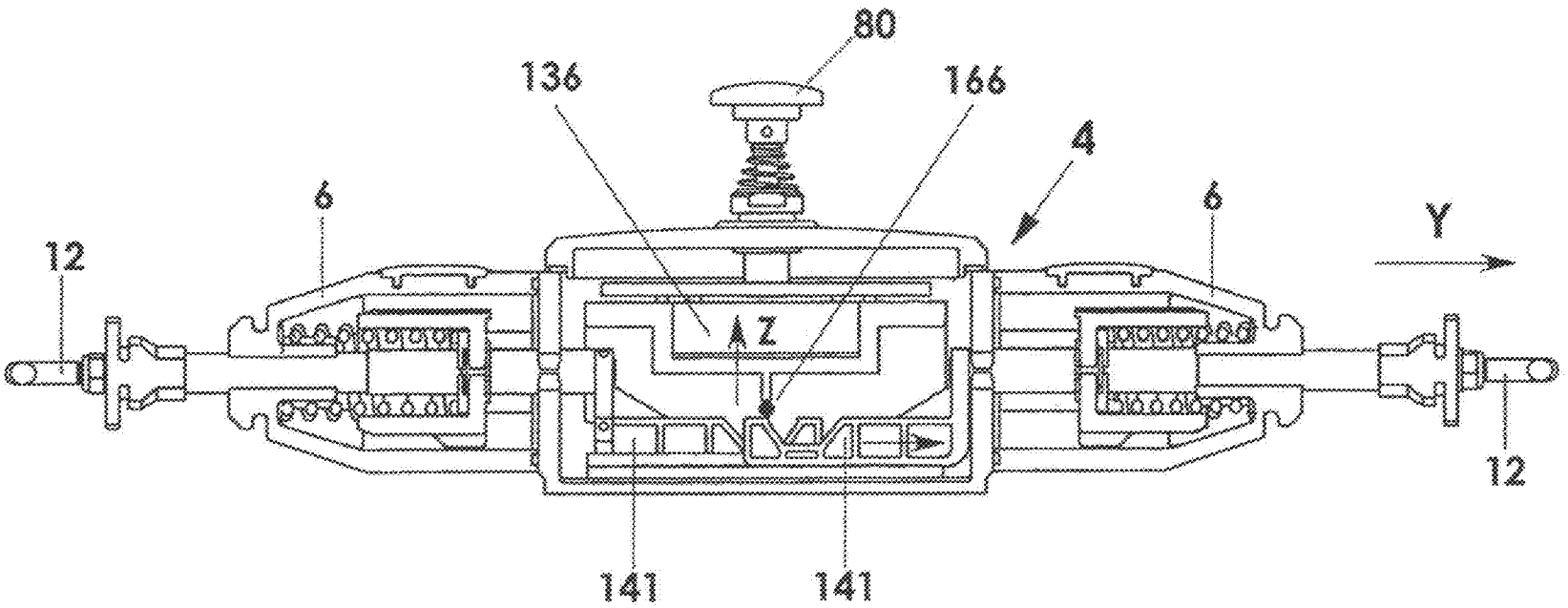

FIG. 10 is an exploded perspective view of a second embodiment of safety switch;

FIG. 11 is a detail of a sliding cam of the second embodiment;

FIG. 12 is a longitudinal sectional view of the second embodiment of safety switch, illustrated in the switch on condition, both ropes correctly tensioned;

FIG. 13 is a view similar to that of FIG. 12 in which the rope to the right of the switch has become slack, the rope to the left of the switch is still tensioned, the switch being in the off condition; and FIG. 14 is a view similar to that of FIG. 13 except the rope to the right is pulled.

A first embodiment of safety switch constructed in accordance with the present invention is best illustrated in FIGS. 1 to 9. The safety switch 2 is switchable between two operating conditions, in a first of which the switch 2 enables power to be supplied to attendant machinery (not illustrated). In the second condition, the switch prevents said power supply. In use a cable under a predetermined tension (not illustrated) is connected to the safety switch, whilst the other end of the cable may be fixed to, for example a fixed support (not illustrated). In the first operating condition the cable is under said tension and the switch 2 is actuated to said second operating condition, thus switching off the power to the machinery, when the tension in the cable exceeds or falls below said predetermined tension. For example if the machine operator pulls the cable or in the later scenario when the cable becomes lose, or breaks.

The safety switch 2 comprises a main housing 4 which supports a spring housing 6. The spring housing 6 comprises a spring loaded shaft 10 which extends between an eyebolt 12 located remote from the main housing 4, and a sliding cam 14 which is located inside the main housing 4. The spring loaded shaft 10 comprises a spring 8 which biases the shaft into the housing. In use said cable is connected to the eyebolt 12 and the spring loaded shaft 10 provides the predetermined tension therein. In the first condition of the switch 2 the cable is tensioned by the spring force of the shaft 10. Whilst in the second condition the spring force and the tension in the cable are no longer balanced with a resultant movement of the shaft and this causes the switch 2 to operate to cut-power to the machinery, which will be described further herein under. The shaft 10 is caused to move into the main housing 4 when the counter balance provided to its spring force by the preset tension in the cable is altered, as described above either by pulling on the cable or if the cable goes slack and loses its predetermined tension.

As mentioned above the cable is attached to the eyebolt 12 with a predetermined tension which in use provides a counterbalance to the spring force of the spring loaded shaft 10 and prevents the shaft from moving. The tension of the cable is set via a calibration means visible through window 7 provided in the spring housing 6, which adjusts the spring force of the shaft.

The main housing 4 comprises a substantially rectangular box having a base plate 16 and four side walls 18, 20 22, 24 and a top plate 26. Top plate 26 provides a means to close the main housing 4 and is fastened to the side walls 18, 20, 22, 24 by fastening means 28.

Within the housing 4 is a contact block 30 containing a number of contacts which can be made or broken in order to switch on and off the power supply to the machinery. The making and breaking of the contacts is by means of a contact block plunger 32 which is retained in the contact block 30 for selective reciprocal movement into and out of the contact block 30, such that movement of the contact block plunger 32 into the contact block 30 acts to break the contacts and terminate the power supply, whilst movement of the plunger 32 out of the contact block 30 acts to make the contacts and to enable power to be supplied to the machinery. The contact plunger 32 is spring loaded such that it is biased for movement out of the contact block 30. The selective actuation of the contact block plunger 32 will be described further herein under.

As previously mentioned the sliding cam 14 is mounted inside the main housing 4, to this end the side wall 18 of the main housing 4 is provided with an opening 34 through which shaft 10 extends. Sliding cam 14 is confined for its longitudinal reciprocal motion with the shaft 10 within the main housing 4 by transverse cam 36.

Transverse cam 36 is a substantially open box shape moulding, the base opening of which faces the base plate 16 of the main housing 4. The transverse cam 36 comprises a roof 38 and four side walls 40, 42, 44, 46. A first of the side walls 40 faces opening 34 and has an opening through which shaft 10 extends such that sliding cam 14 is retained for its said movement within the inner cavity of said box shaped transverse cam 36.

As best illustrated in FIGS. 3 to 5 side wall 44 of said transverse cam 36, which is located opposite its wall 40 providing the opening for shaft 10, comprises an abutment profile on its exterior surface for operation of the contact block plunger 32. To this end the exterior of wall 44 is provided with a cut-away portion 52 adjacent the roof 38 of the transverse cam 36 and a sloping surface 54 extending between the cut-away portion 52 and the remaining portion of the wall 56 which later is located adjacent the opening of the box-shape of the transverse cam 36.

The transverse cam 36 is moveable between two positions, in a direction which is in transverse plane to the plane of movement of shaft 10 and therefore sliding cam 14. In a first of the positions the transverse cam 36 is located adjacent base plate 16 of the main housing 4 and contact plunger 32 extends into the cut away portion 52 of the wall 44 such that it is biased out of the contact block 30 enabling the power to be supplied to the machinery. In the second position the transverse cam 36 is located adjacent the top plate 26 of the main housing 4 and contact plunger 32 is forced into the contact block by the remaining portion 56 of the wall 44 thereby enabling the power to be cut to the machinery. The slanting surface 54 between the remaining wall 56 and the cut-away portion 52 provides a smooth, but rapid transition for movement into and out of the contact block 30 for the contact block plunger 32, as the transverse cam 36 moves between its first and second positions.

The transverse cam 36 is moved between its said first and second positions by the sliding cam 14, to this end the inside of the roof 38 or ceiling 60 of the vertical cam 36 is provided with an abutment profile, as best illustrated in FIGS. 3 to 5, for contact with the sliding cam 14. The ceiling 60 is provided with a substantially central recess 62 between two dependent shoulders 64, 66. A respective slanting surface 68, 70 or ramp surface is provided between each shoulder 64, 66 and the central recess 62. The end of the sliding cam 14 facing the ceiling 60 has a substantially v-shaped profile providing respective complementary ramp surfaces 72, 74.

As best illustrated in FIG. 3 in the first condition of the safety switch 2, in which power is supplied to the machinery, the tension in the cable and the spring force of the spring biased shaft 10 are counter balanced and the sliding cam 14 is immobile and extends into the recess 62 provided in the ceiling 60 of the vertical cam 36 and the vertical cam 36 is also in its first position.

As best illustrated in FIG. 4 if the cable is pulled to initiate an emergency stop, the tension in the cable exceeds that of the spring force of the shaft 10 and the shaft 10 is pulled outwardly of the main housing 4 moving the sliding cam 14 therewith. The slanting surface 72 of the v-shaped profile on the sliding cam 14 contacts the ramp surface 68 of the ceiling 60 nearest to the opening in wall 40 and forces the vertical cam 36 to move towards its second position as the sliding cam 14 is forced over said ramped surface 68, until the sliding cam 14 is located under shoulder 64. Likewise as best illustrated in FIG. 5, the vertical cam is moved from its first position shown in FIG. 3 to its second position, enabling the power to be cut when the tension in the cable is slackened; in which instance the spring force of the shaft 10, which is naturally biased into the main housing 4 exceeds that of the cable. In this instance the opposite slanting surface 74 of the sliding cam 14 makes operative contact with the opposite ramped surface 70 on the ceiling 60 as the shaft 10 moves further into the main housing 4, forcing the vertical cam 14 into its second position in which the power is cut to the machinery and it comes to rest under shoulder 66 of the ceiling 60.

The transverse cam 36 is selectively retained in its first and second positions in that transverse cam's 36 opposite side walls 42, 46, as best illustrated in FIGS. 6 and 7, each comprise on their exterior surface oppositely disposed first detents 48 and oppositely disposed second detents 50. Second detents 50 are shallower than the first detents 48 and are located between the first detents 48 and the ceiling 38 of the transverse cam 36. The detents 48 and 50 provide an abutment profile to the exterior of the opposite side walls 42 and 46 of said transverse cam 36. Within the main housing 4 is mounted two fixed pillars 76 each located adjacent a respective side wall 42 and 46. Each pillar 76 has a blind-bore in which is retained a respective spring loaded plunger 78, which is biased out of the pillar 76 towards the respective adjacent side wall 42, 46. In the first position of the transverse cam 36 in which the power is on, the plungers 78 engage detents 50 located nearest the roof 38. In the second position of the transverse cam 36 in which the power is off, the plungers 78 engage detents 48. By engagement in the respective detents 48, 50 the movement of the transverse cam 36 is held at its respective end positions for said first and second positions.

In the power on position, the transverse cam 36 is held in position by the engagement of plungers 78 in the shallower of the detents 50. When the tension in the cable is altered the sliding cam 14 moves longitudinally and forces the vertical cam to move transversely thereto, as described above. When this happens the spring force of the plungers 78 is overcome and the plungers 78 are forced out of detents 50 and travel along the respective side walls 42, 46, which prevents the transverse cam 36 from moving in the longitudinal direction. When the transverse cam 36 reaches its second position, in which the power is off, the plungers 78 come into engagement with the deeper of the detents 48, and is thereby prevented from further travel.

The transverse cam 36 is prevented from returning to the first position, firstly by the sliding cam 14 which now sits under either shoulder 64 or 66 of the ceiling of the transverse cam 36, and by the stronger hold of the plungers 78 engaging in the much deeper detents 48. Whilst the shallower detents 50 provide a quicker release mechanism enabling the transverse cam to reach its second position rapidly, the deeper detents 48 require a considerably higher force to be applied to the plungers 78 in order for them to release their hold. This prevents accidental resetting of the switch to its first condition, in which the power is on, even in the event that further movement of the cable returns the sliding cam 14 to its start position where it extends into recess 62 of ceiling 60 and therefore no longer provides an abutment for the transverse cam 36 to prevent its travel.

In order to reset the switch to its first condition and restore power to the machinery, the safety switch is further provided with a reset knob which comprises a knob 80 mounted on a shaft 82. The shaft 82 is mounted for reciprocal movement though an aperture in top plate 26. The knob 80 is mounted at one end of the shaft 82 and lies outside the main housing 4. Depression of the knob 80 causes the shaft 82 to enter further into the housing 4 and to come into contact with roof 38 of the transverse cam 36, further movement down forces the plungers 78 out of detents 48 and moves the transverse cam 36 back to its first position. However, the transverse cam 36 is prevented from movement if the sliding cam 14 has not been stored to its start position, in which case the sliding cam 14 blocks the movement of transverse cam 36 by its abutment with shoulder 64 or 66 of the ceiling 60 of transverse cam 36. In order to restore the transverse cam 36 to its first position, it is necessary to firstly restore the tension in the cable in order for it to counter balance the spring force of shaft 10. This enables the sliding cam 14 to move back to its stat position whereat it lies adjacent recess 62 of ceiling 60 and no longer provides a barrier to the movement of transverse cam 36. Hence, the power can be restored to the machinery with the safety switch once again fully functional for an emergency stop.

The safety switch, as best illustrated in FIGS. 8 and 9 also comprises an additional stop mechanism, this enables an emergency stop without pulling on the cable and therefore if the machine operator is by the switch it enables the direct initiation of the stop sequence. To this end each of the side walls 42 and 46 of the transverse cam 36 comprise a further abutment profile in the form of a respective shoulder 84 which extends outwardly from the roof 38 region thereof. Each shoulder 84 comprises a substantially triangular shaped profile. An emergency stop button 86 is also provided which comprises a spring loaded shaft 88 which is slidably retained in an aperture 90 in either side wall 20 or 24 of the main housing 4. The spring loaded shaft is biased to move the shaft out of the housing. The provision of apertures 90 in each side wall 20 and 24 enables the emergency stop button 86 to be mounted at either side, thereby the most easily accessible side can be selected, or indeed an emergency stop button 86 may be placed at both said sides of the main housing 4.

In the power on position, as best illustrated in FIG. 8 the transverse cam 36 is located in its first position and shaft 88 is biased by spring 92 outwardly of the main housing 4 and does not contact the transverse cam 36. However, to initiate an emergency stop the operator depresses the button 86 overcoming the spring 92 and forcing the shaft 88 further into the main housing and into contact with underside of shoulder 84 of transverse cam 36 to thereby force the transverse cam 36 to move into its second position and thereby cut power to the machinery by releasing contact block plunger 32 from the contact block.

In a further embodiment, as best illustrated in FIGS. 10 to 14, the safety switch is modified in order to enable two cables to be attached, each under a predetermined tension. In this embodiment if either cable becomes slack, or breaks, or is pulled the power supplied to the attendant machinery is terminated.

To this end a respective spring housing 6 is mounted to opposite sides of the main housing 4. Each spring housing is constructed as per the previous embodiment and each carries at its end remote from the main housing 4 a respective eyebolt 12 for connection to a respective cable as described above. Each also carries a respective sliding cam 141 at the opposite end of the shaft 10, which cams 141 are retained within the main housing 4.

Each of the sliding cams 141 are retained within the same transverse cam 136 for respective longitudinal reciprocal motion along the substantially the same axis. To this end the transverse cam 136, as best illustrated in FIG. 10, has an elongate u-shaped structure and a respective sliding cam 141 extends therein from opposite sides thereof. Each sliding cam 141 carries a respective abutment profile, as best illustrated in FIG. 10 which is open towards the interior surface of the transverse cam 136 and each, forms an abutment surface for a single abutment 166 inside the transverse cam 136 as best illustrated in FIGS. 12 to 14.

The abutment surface of each sliding cam 141, as best illustrated in FIG. 11, has a central recess 162 between two shoulders 164, 166, a respective slanting surface 168, 170 or ramp surface is provided between each shoulder 164, 166 and the central recess 162. This is a similar abutment profile to that provided by the transverse cam 36 of the first embodiment. In this embodiment the single abutment 166 extends down from the interior of the transverse cam 36 towards the sliding cams 141 and is in the form of a wall which divides the u-shaped structure of the transverse cam 136 into two longitudinal sections. The two sliding cams 141 lie side by side inside the transverse cam 136 and as best illustrated in FIG. 12 lie such that their abutment profiles are aligned such that their central recesses 162 coincide and the abutment 166 of the transverse cam 136 extends into both central recesses 162 of the sliding cam, thereby retaining the cams 136 for a limited longitudinal movement over the breadth of the expanse of the central recess 162 between the shoulders 164, 166. This enables a small range of cable tension variation which does not lead to activation of the switch in order to account for changes in the tension due to changes in the environment, for example variations in temperature and humidity.

In FIG. 12 the safety switch is shown in a condition in which attached cables (not illustrated) are at the defined predetermined tension and the two sliding cams 141 are aligned as described above. FIG. 13 shows the condition of the safety switch when the cable on the right becomes slack and the spring force moves the attached cam 141 in the direction X and abutment 166 comes into engagement with ramp surface 170 which forces the abutment 166 upwards in the direction Z. This moves the transverse cam 136 from its first to its second position in order to cut the power to the machinery. Similarly as shown in FIG. 14 when the cable on the right is pulled the sliding cam 141 moves in the other direction Y and the abutment 166 is moved upwards by the opposite ramp surface 168, in order to cut power. In the illustration of both FIGS. 13 and 14 the other cable attached to the switch remains correctly tensioned and the other sliding cam 141 remains stationary. Although it is to be understood that the other sliding cam 141 can activate the safety switch in the same manner.

The transverse cam 136 is mounted in the housing 4 is the same manner as per the previous embodiment in that it is retained for movement between the said two positions by detents 48 and 50 and pillars 76 which retain the spring loaded plungers 78. When the transverse cam 136 is in its second position, power-off, and is retained by plungers 78 in the deeper detents 48, it is not only prevented from returning to the first position by the stronger hold of the plunger 78 within the deeper detents 48, but also by the abutment 166 engaging the shoulder 166 of the sliding cam 141 (in the switch position of FIG. 13) or shoulder 164 of the sliding cam 141 (in the switch position of FIG. 14). The switch can only be reset when the sliding cam 141 is returned to the start position shown in FIG. 12, in which the cable is correctly tensioned and the respective shoulder 164, 166 no longer blocks the decent of abutment 166 when the reset button is depressed to force the plungers from the detents 48 to return the transverse cam 136 to its first position.

Also as per the previous embodiment, movement of the transverse cam between the first and second position, switches the power to the machinery on and off. In this instance there are two contact blocks 30, 30 each having respective plungers 32 which are forced in and out of their respective blocks 30 by the abutment profile on the exterior of the transverse cam 136. Also an emergency button is provided which can be optional mounted in the main housing to immediately activate the movement of the transverse cam 136.

It is of course to be understood that the invention is not intended to be restricted to the details of the above embodiment which is described by way of example only.

The invention claimed is:

1. A safety switch comprising a transverse cam, a sliding cam which acts on the transverse cam to move it from a first position in which said transverse cam enables a power supply to a second position in which said transverse cam acts to cut said power supply, wherein said sliding cam has connecting means to connect to a cable, tension means to provide a predetermined tension in a connected cable and moving means to move said sliding cam when said applied predetermined tension varies, wherein said sliding cam is moveable in a first plane and said transverse cam movement is in a second plane transversely disposed to said first plane, and wherein the switch further comprises means to releasably retain the transverse cam in said first or second position and the means to retain comprises at least one fixed structure comprising at least one detent or spring loaded plunger, the other of which is carried on a surface of the transverse cam, with the spring loaded plunger being adapted to be releasably retained in the detent.

2. A safety switch according to claim 1, wherein there are two pairs of oppositely disposed detents which are spaced apart in a plane parallel to said second plane, and a pair of oppositely disposed said plungers, wherein in said first position of said transverse cam the oppositely disposed plungers extend into a respective first of said pair of detents and in said second position the plungers extend into respective said second pair of said detents.

3. A safety switch according to claim 2, wherein the second pair of detents are arranged so as to be deeper than said first pair.

4. A safety switch according to claim 1, wherein the means to releasably retain the transverse cam in the second position comprises mating abutments on the sliding cam and the transverse cam which are adapted to be aligned to prevent movement of the transverse cam when the sliding cam is moved when applied tension is varied and move out of aligned enabling movement of the transverse cam when said predetermined tension is restored.

5. A safety switch according to claim 1, wherein the switch is provided with a manually operable reset plunger which act on the transverse cam in the opposite direction to the sliding cam.

6. A safety switch according to claim 1, in which the switch is provided with an emergency stop button which has means to move the transverse cam to said second position thereof.

7. A safety switch according to claim 6, wherein the transverse cam has a protrusion and the emergency button has means to act on said protrusion.

8. A safety switch according to claim 6, wherein the switch is provided with at least two mountings for said emergency button.

9. A safety switch according to claim 1, wherein the connecting and moving means includes a shaft on which the sliding cam is mounted.

10. A safety switch according to claim 9, wherein an eyelet is mounted to the shaft.

11. A safety switch according to claim 9, wherein the shaft is spring loaded to provide said tension means.

12. A safety switch according to claim 1, wherein the means to enable the power supply comprises an abutment profile on the surface of the transverse cam for the switching mechanaism.

13. A safety switch according to claim 12, wherein the switching mechanism is of the type comprising a contact block wherein the switching contact is a spring loaded plunger.

14. A safety switch according to claim 12, wherein the switching contact is a spring loaded plunger of a contact block which is biased for movement out of the contact block, wherein said abutment profile has means to move the plunger into the contact block when in said first or second position of the transverse cam.

15. A safety switch according to claim 13, wherein the spring loaded plunger is biased out of the contact block to enable power to be supplied, said power being cut when the plunger is moved into the contact block, wherein the means on the abutment profile to move the plunger into the contact block operates the plunger when the transverse cam is in said second position.

16. A safety switch according to claim 12, wherein the switch incorporates said switching mechanism.

17. A safety switch according to claim 1, wherein the surface of the sliding cam or transverse cam facing the other of the transverse cam or sliding cam has an abutment profile comprising a well with ramped sides, whilst the other of the transverse cam or sliding cam has a projection which extends into the well when the transverse cam is in said first position, wherein said means to move said sliding cam is adapted to move the sliding cam in a first direction in said plane when said cable tension exceeds said predetermined tension and enable the projection to abut a first of the ramped sides to move the transverse cam to said second position, and said means is adapted to move the sliding cam in the opposite direction in said plane when said cable tension is less than said predetermined tension and to enable the projection to abut the second of the ramped sides to move the transverse cam to said second position.

18. A safety switch as claimed in claim 17 wherein the rim of the well provides the or a mating abutment which prevents movement of the transverse cam to the first position by blocking movement of the protection back into the well.

19. A safety switch according to claim 1, further comprising two of said sliding cams each of which can act on the transverse cam to move it from its said first to second position, each sliding cam having respective connecting means to connect to a respective cable and respective moving means.

* * * * *